US005361123A

United States Patent [19]

Yeh et al.

[11] Patent Number: 5,361,123

[45] Date of Patent: Nov. 1, 1994

[54] MICROCONTROLLER BASED XEROGRAPHIC CHARGE DEVICE POWER SUPPLY

[75] Inventors: Thomas I. Yeh, Penfield; Clifford K. Friend, Pittsford; Timothy A. Cole, Henrietta; Leo R. Farnand, Fairport, all of N.Y.

[73] Assignee: Xerox Corporation, Stamford, Conn.

[21] Appl. No.: 110,749

[22] Filed: Aug. 23, 1993

[51] Int. Cl.[5] ..... G03G 15/28

[52] U.S. Cl. ..... 355/208; 355/225; 361/235

[58] Field of Search ..... 361/235; 250/325; 355/203, 204, 208, 205, 207, 225, 221

[56] References Cited

U.S. PATENT DOCUMENTS

| | | | |
|---|---|---|---|
| 3,934,141 | 1/1976 | Vargas, Jr. | 250/325 |
| 4,166,690 | 9/1979 | Bacon et al. | 355/225 |
| 4,248,519 | 2/1981 | Urso | 355/221 X |
| 4,355,885 | 10/1982 | Nagashima | 355/208 |
| 4,417,804 | 11/1983 | Werner, Jr. | 355/221 |
| 4,456,370 | 6/1984 | Hayes, Jr. . | |
| 4,456,825 | 6/1984 | Kuge et al. | 250/325 X |
| 4,714,978 | 12/1987 | Coleman | 361/235 |
| 4,920,266 | 4/1990 | Reale . | |
| 5,132,869 | 7/1992 | Nakaya | 361/233 |
| 5,140,349 | 8/1992 | Abe et al. | 346/160 |
| 5,164,776 | 11/1992 | Oresick et al. | 355/208 |

*Primary Examiner*—A. T. Grimley
*Assistant Examiner*—Nestor R. Ramirez
*Attorney, Agent, or Firm*—Ronald F. Chapuran

[57] ABSTRACT

A charging device for producing a voltage potential on a photoconductive member including a corona generator for charging a portion of the image receptor to a substantially uniform potential; a corona generating potential source electrically connected to the corona generator; a sensor for determining the potential on the image receptor; and a microprocessor including an analog to digital converter interconnected to the corona generating potential source; the sensor; and the controller for regulation of the potential on the image receptor.

4 Claims, 4 Drawing Sheets

MICROCONTROLLER BASED XEROGRAPHIC CHARGE DEVICE POWER SUPPLY

BACKGROUND OF THE INVENTION

1. Field of the Invention

This invention relates generally to an electrophotographic printing system, and more particularly concerns a microcontroller based xerographic charge device power supply.

2. DESCRIPTION OF THE PRIOR ART

The basic xerographic process comprises exposing a charged photoconductive member to a light image of an original document. The irradiated areas of the photoconductive surface are discharged to record thereon an electrostatic latent image corresponding to the original document. A development system next moves a developer mix of carrier granules and toner particles into contact with the photoconductive surface. The toner particles are attracted electrostatically from the carrier granules to the latent image forming a toner powder image. Thereafter, the toner powder image is transferred to a sheet of support material. The sheet of support material then advances to a fuser which permanently affixes the toner powder image thereto.

Before the photoconductive member can be exposed to a light image, the photoconductive member must be charged by a suitable device. This operation is typically performed by a corona charging device. One type of corona generator consists of a current carrying wire enclosed by a shield on three sides and a wire grid over and spaced apart from the open side of the shield. A uniform potential is applied to the wire and the wire grid. Electrostatic fields develop between the charged wire and the shield, between the wire and the grid, and between the charged wire and the (grounded) photoconductive member. Electrons are repelled from the wire and the shield resulting in a charge at the surface of the photoconductive member. The wire grid, located between the wire and the photoconductive members, because of the field between the grid and the wire, helps control the charge strength and uniformity on the photoconductive member caused by the other aforementioned fields.

The control of the charge strength and uniformity on the photoconductive member is very important because consistent high quality reproductions are best produced when a uniform charge is obtained on the photoconductive member. If the photoconductive member is not charged to a sufficient potential, the electrostatic latent image obtained upon exposure will be relatively weak and the resulting deposition of development material will be correspondingly lessened. As a result, the copy, produced therefrom, will be faded. If, however, the photoconductive member is overcharged, the converse will occur and too much developer material will be deposited on tile photoconductive member. As a consequence, the copy produced will have a gray or dark background instead of the white background of the copy paper. Areas intended to be gray are black. Tone reproduction is poor. Additionally, if the photoconductive member is overcharged, the photoconductive member can be permanently damaged.

In a typical xerographic charging system, the amount of voltage obtained at the point of electrostatic voltage (ESV) measurement of the photoconductive member is less than the amount of voltage applied at the point of charge application. In addition, the amount of voltage applied to the corona generator required to obtain a desired constant voltage on the photoconductive member must be increased or decreased according to various factors which affect the photoconductive member. Such factors include the rest time of the photoconductive member between printing, the voltage applied to the corona generator for the previous printing job, the copy length of the previous printing job, machine to machine variance, the age of the photoconductive member and changes in the environment.

Historically, the only factor corrected in applying a voltage on the corona generator to obtain a uniform voltage at the photoconductive member was a rest recovery correction factor. The rest recovery factor attempted to correct for the fact that the photoreceptor responds to charges differently after it is allowed to rest at which time no charge is applied. Preferably, the manner of adjusting the voltage at the corona generator was to adjust the voltage applied to the wire grid.

For example, it would not be uncommon at the end of a 200 copy job for the corona charging device of a copier to generate 1200 volts to obtain 900 volts at the point of measurement on the photoconductive member as measured by an electrostatic voltmeter. After allowing the copier to remain idle for 15 minutes, the corona generator might then need to put out only 1000 volts to obtain 900 volts on the photoconductive member.

Although the classical rest recovery factor has proven beneficial in the control of the charge strength and uniformity on a photoconductive member, there is a need to correct the great many factors which affect the charge strength and uniformity on a photoconductive member.

The problems with typical xerographic charging control systems are not limited to the difficulties associated with rest recovery. In a typical charge control system, the point of charge application, and the point of charge measurement is different. The zone between these two devices loses the immediate benefit of charge control decisions based on measured voltage error since this zone is downstream from the charging device. This zone may be as great as a belt revolution or more due to charge averaging schemes. This problem is especially evident in aged photoreceptors because their cycle-to-cycle charging characteristics are more difficult to predict. The problem results in improper charging, often leading to early photoreceptor replacement. Thus, there is a need to anticipate what the next cycles behavior will be and compensate for it beforehand.

Other difficulties with typical xerographic charging control systems are the calculation and communication requirements placed on a central or main controller. The main controller is often burdened with general process control, diagnostic, and communications requirements that increase the possibility of software crashes and noise induced error signals that undercut the charging function performance as well as the overall machine performance.

The prior art is replete with various charging control techniques. For example, U.S. Pat. No. 4,796,064 discloses a control device for adjusting the surface potential of an image bearing member during the initial cycles of a job run wherein the image bearing member manifests varying characteristics after completion of a job run. The control device includes logic circuitry having means to predict changed characteristics of the image bearing member ,after completion of a first job run at the initiation of a second job run and means to determine a relationship between a charging current of a charging member and a measured surface potential of the image bearing member. More specifically, the control device predicts the charging characteristics of the image bearing members as a function of a rest recovery and a cumulative sum of previous jobs.

U.S. Pat. No. 4,806,980 discloses a feedforward process control for an electrophotographic machine wherein an initial voltage level and an exposure level are process control parameters of the machine. Signals are produced and stored having values characteristics of: (1) a level of at least one of the parameters; and (2) a bias voltage level. A comparison signal is produced by comparing the signal values of charges and the sensed parameters associated with the latent images with the stored signal values for the corresponding latent charge images. Compensation algorithms are used to compensate for noise and disturbances in the initial charge. The effect of the noise and disturbances affects the results.

A difficulty with prior art systems is generally that xerographic power supplies are designed to interface with a central control board through dedicated signal wires. The wiring harness interconnecting each xerographic power supply to the control board must generally support control analog signals (0–10 V), and monitor signals such as analog signals (0–10 V), a digital fault status signal and a digital enable signal. The number of wires is further multiplied by the numbers of xerographic power supplies used in a high volume machine. The resultant wiring harness is a significant contributor to the machine level cost and quality concerns. In addition, the analog signals can be easily contaminated by noise signals propagated throughout the machine environment.

In addition, xerographic power supplies, by nature, represent a hostile environment to digital electronic integrated circuits. The coexistence of 5 V digital controller signals along side high voltage (up to 10 KV) generator signals dictate prudent consideration at the onset of design. Arc discharges, common within the xerographic process, posses a significant risk of catastrophic disruption to the operation of control circuitry. Past experiences have demonstrated the susceptibility of digital electronics to the conducted and radiated energy generated by an arc discharge.

It would be desirable, therefore, to overcome the above identified difficulties in the prior art. It is an object, therefore, of the present invention to provide a xerographic charge device power supply incorporating a microcontroller within the power supply to provide direct local process control and digital communication to link the main controller in the machine. Another object of the present invention is to reduce the wiring requirements to and from the power supply while increasing the communications capability of the power supply. Still another object of the present invention is to provide a charging device power supply that eliminates an external signal conversion printed wiring board. Another object of the present invention is to provide a charging device power supply incorporating internal diagnostic and supervisory functions for communication to the main controller. Other advantages of tile present invention will become apparent as the following description proceeds, and the features characterizing the invention will be pointed out with particularity in the claims annexed to and forming a part of this specification.

SUMMARY OF THE INVENTION

There is provided an electrophotographic printing machine of the type having a latent image recorded on a photoconductive member during successive printing cycles of successive print jobs. The improvement is a charging device for producing a voltage potential on the photoconductive member, including: a corona generator for charging a portion of the image receptor to a substantially uniform potential; a corona generating potential source electrically connected to the corona generator; a sensor for determining the potential on the image receptor; and a microprocessor including an analog to digital converter interconnected to the corona generating potential source; the sensor; and the controller for regulation of the potential on the image receptor.

In the drawings and the following description, it is to be understood that like numeric designations refer to components of like function. While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE PREFERRED EMBODIMENTS

Figure 1:
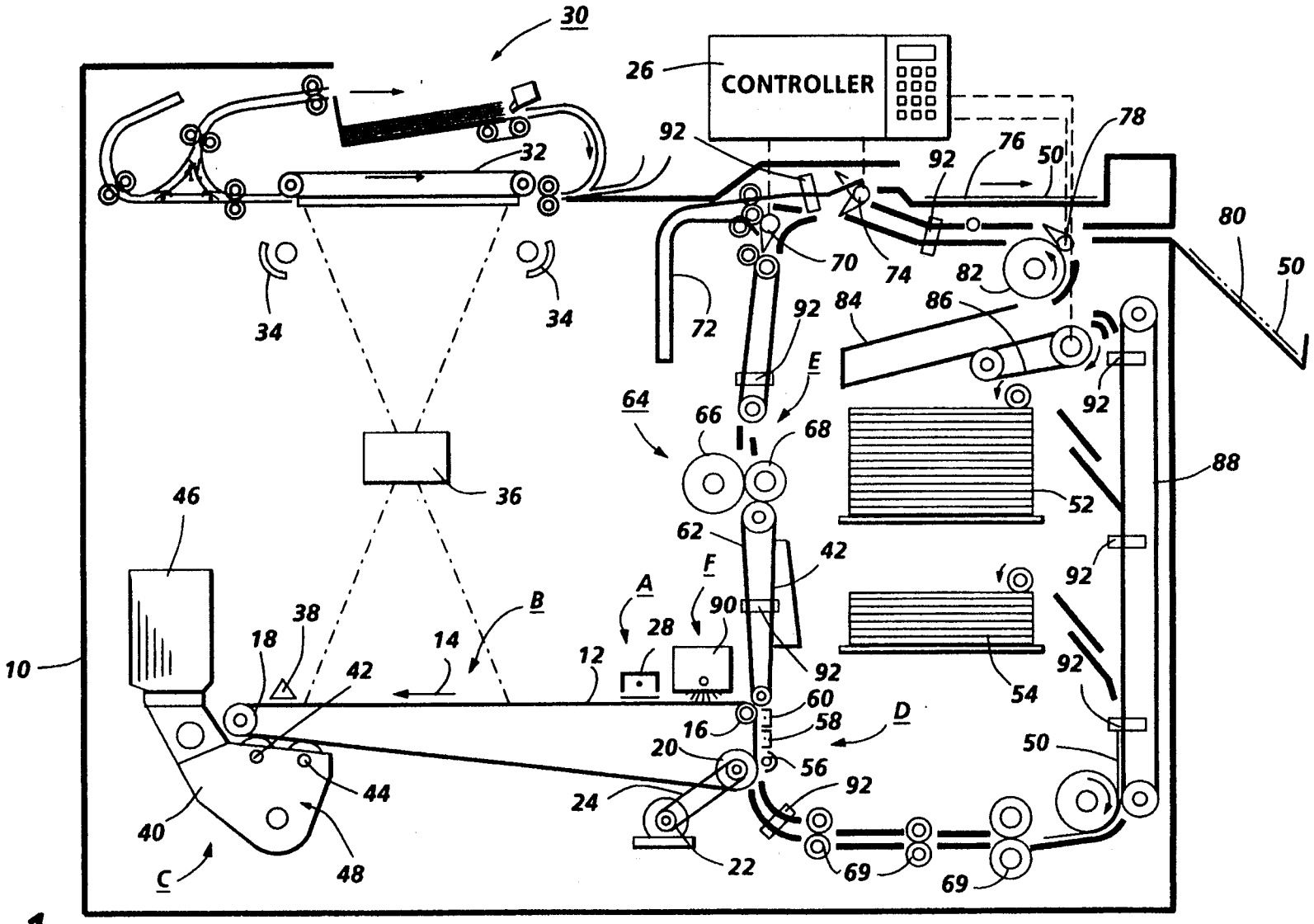
FIG. 1 is a schematic, elevational view showing an illustrative electrophotographic printing machine incorporating the features of the present invention therein.

Although specific terms are used in the following description for the sake of clarity, these terms are intended to refer only to the particular structure of the invention selected for illustration in the drawings, and are not intended to define or limit the scope of the invention.

Describing now the specific example illustrated in the Figures, there is schematically shown in FIG. 1 an exemplary electrophotographic printing system incorporating the features of the present invention therein. It will become evident from the following discussion that the present invention is equally well suited for use in a wide variety of printing systems, and is not necessarily limited in its application to the particular electrophotographic printing system shown herein.

The exemplary electrophotographic printing system may employ a photoconductive member such as photoconductive belt 12. The photoconductive belt 12 moves in the direction of arrow 14 to advance successive portions of the photoconductive surface sequentially through the various processing stations disposed about the path of movement thereof. Belt 12 is entrained about stripping roller 16, tensioning roller 18, and drive roller 20. Stripping roller 16 is mounted rotatably so as to rotate with belt 12. Tensioning roller 18 is resiliently urged against belt 12 to maintain belt 12 under the desired tension. Drive roller 20 is rotated by a motor 22 coupled thereto by suitable means, such as a belt drive 24. A controller 26 controls the motor 22 in a manner known to one skilled in the art to rotate the roller 20. As the drive roller 20 rotates, it advances belt 12 in the direction of arrow 14.

Initially, a portion of the photoconductive surface passes through charging station A where a charging corona generating device 28, hereinafter referred to as a corona generator 28, charges photoconductive belt 12 to a relatively high, substantially uniform potential. The corona generator 28 comprises corona generating wires called the coronode, a shield partially enclosing the coronode, and a wire grid disposed between the belt 12 and the unenclosed portion of the coronode. The coronode wires, by corona discharge, charge the photoconductive surface of the belt 12, Next, the charged portion of photoconductive belt 12 is advanced through imaging station B. At imaging station B, a document handling unit, indicated generally by the reference numeral 30, provides for automatically feeding or transporting individual registered and spaced document sheets onto and over the imaging station B, i.e., over the platen of the copier 10. A transport system 32 may be an incrementally servo motor driven non-slip or vacuum belt system which is controlled by the copier controller 26, in a manner known to one skilled in the art, to stop the document at a desired registration (copying) position.

When the original document is properly positioned on the platen, imaging of a document is achieved by two Xenon flash lamps 34, mounted in an optics cavity for illuminating the document. Light rays reflected from the document are transmitted through a lens 36. The lens 36 focuses light images of the original document onto the charged portion of the photoconductive surface of belt 12 to selectively dissipate the charge thereon. This records an electrostatic latent image on photoconductive belt 12 which corresponds to the informational areas contained within the original document.

One skilled in the art will appreciate that instead of a light lens optical system, a raster input scanner (RIS) in combination with a raster output scanner (ROS) may be used The RIS captures the entire image from the original document and converts it to a series of raster scan lines. The RIS contains document illumination lamps, optics, a mechanical scanning mechanism, and a photosensing element, such as charge coupled device (CCD array). The ROS, responsive to the output from the RIS performs the function of recording the electrostatic latent image on the photoconductive surface. The RIS lays out the latent image in a series of horizontal scan lines with each line having a certain number of pixels per inch. The ROS may include a laser, rotating polygon mirror blocks, and a modulator. Other suitable devices may be used in lieu of a laser beam, for example, light emitting diodes may be used to irradiate the charged portion of the photoconductive surface so as to record selected information thereon. Still another type of exposure system employs only an ROS. The ROS is connected to a computer and the document desired to be printed is transmitted from the computer to the ROS. In all of the foregoing systems, the charged photoconductive surface is selectively discharged to record an electrostatic latent image thereon. Thereafter, belt 12 advances the electrostatic latent image recorded on the photoconductive surface towards development station C. After imaging, the original document is returned to the document tray from the transport system 32.

Before reaching the development station C, the photoconductive belt 12 advances beneath a voltage monitor, preferably an electrostatic voltmeter 38 for measurement of the voltage potential of the photoconductive belt 12. The electrostatic voltmeter 38 can be any suitable type known in the art. Typically, an electrometer probe, controlled by a simple switching arrangement, senses the charge on the photoconductive surface of the belt 12. The switch arrangement provides the measuring condition in which voltage is induced on a probe electrode corresponding to the sensed level of the belt 12. The induced voltage is proportional to the internal capacitance of the probe plus its connected circuitry, relative to the probe-to-measured surface capacitance. A simple D.C. measurement circuit is combined with the electrostatic voltmeter circuit. The measuring circuit output can be read by a conventional test meter. The voltage potential measurement of the photoconductive belt 12 is utilized to maintain a uniform potential thereon, as will be understood when the specific subject matter of the present invention is explained in detail.

Thereafter, the photoconductive belt 12 advances to the development station C. At development station C, a magnetic brush developer unit, indicated generally by the reference numeral 40, advances the developer material into contact with the electrostatic latent image. Preferably, magnetic brush development system 28 includes two magnetic brush developer rollers 42 and 44. These rollers each advance developer material into contact with the latent image. Each developer roller 42 and 44 forms a brush comprising carrier granules and toner particles. The latent image attracts the toner particles from the carrier granules, forming a toner powder image on the latent image. As successive latent images are developed, toner particles are depleted from the developer 40. A toner particle dispenser 46 is arranged to furnish additional toner particles to a developer housing 48 for subsequent use by developer rollers 42 and 44, respectively. The toner dispenser 46 includes a container storing a supply of toner particles. A foam roller disposed in a sump coupled to the container dispenses toner particles into an auger. The toner particles are then dispensed into the developer housing 48. The belt 12 then advances the toner powder image to transfer station D.

At transfer station D, a copy sheet 50 is moved into contact with the toner powder image. Copy sheets, such as sheet 50, can be conventionally fed from either paper trays 52 or 54 to receive an image. Prior thereto, photoconductive belt 12 is exposed to a pre-transfer light from a lamp 56 to reduce the attraction between photoconductive belt 12 and the toner powder image. Next, a corona generating device 58 sprays ions on the back side of the copy sheet 50. The copy sheet 50 is charged to the proper magnitude and polarity so that the copy sheet 50 is tacked to photoconductve belt 12 and the toner powder image is attracted from the photoconductive belt 12 to the copy sheet 50. After transfer, an optionally included corona generating device 60 charges the copy sheet 50 to the opposite polarity to detack the copy 50 sheet from belt 12. Conveyor 62 advances the copy sheet to fusing station E.

Fusing station E includes a fuser assembly, indicated generally by the reference numeral 64 which permanently affixes the transferred toner powder image to the copy sheet. Preferably, fuser assembly 64 includes a heated fuser roller 66 and a pressure roller 68 with the powder image on the copy sheet contacting fuser roller 66. The pressure roller 68 is cammed against the fuser roller 66 to provide the necessary pressure to fix the toner powder image to the copy sheet 50. (Although not illustrated, the following operation occurs.) The fuser roller 66 is internally heated by a quartz lamp. Release agent, stored in a reservoir, is pumped to a metering roll. A trim blade trims off the excess release agent. The release agent transfers to a donor roller and then to the fuser roller 66. The release agent on the fuser roller 66 prevents the toner from sticking to the fuser roller 66, as well as keeping the fuser roller 66 lubricated and clean.

After fusing, the sheet 50 is fed to gate 70 which functions as an inverter selector. Depending upon the position of gate 70, the sheet 50 will be deflected into sheet inverter 72, or will bypass the inverter and be fed directly to a second decision gate 74. The sheets which bypass the inverter 72, turn a 90° corner in the sheet path before reaching the gate 74. At the gate 74, the sheet 50 is in a face-up orientation with the imaged side, which has been fused, face-up If the inverter path 72 is selected, the opposite is true, i.e., the last printed side is facedown. The decision gate 74 either deflects the sheet 50 directly into an open output tray 76 or deflects the sheet 50 into transport path which carries them onto a third decision gate 78. The gate 78 either passes the sheet 50 to an output bin 80 or deflects the sheet 50 onto a duplex inverter roll 84. The inverter roll 64 inverts and stacks the sheet 50, if to be duplexed, in duplex tray 84 when gate 78 so directs. Duplex tray 84 provides an intermediate or buffer storage for those sheets which have been printed on one side and which an image will be subsequently printed on the second, opposed, side thereof, i.e., the sheets being duplexed. Due to sheet inverting by roller 84, the buffer sheets are stacked in the duplex tray 84 face down on top of one another in the order in which they are copied.

In order to complete duplex copying, the simplex sheets in tray 84 are fed in seriatim, by bottom feeder 86 from tray 84 back to transfer station D for transfer of the toner powder image to the opposite side of the sheet. Conveyor 88 advances the sheet 50 along the path which produces an inversion thereof. However, inasmuch as the bottom most sheet is fed from duplex tray 84, the proper or clean side of the sheet 50 is positioned in contact with belt 12 at transfer station D so that the toner powder image is transferred thereto. The duplex sheets are then fed through the same path as the simplex sheets and are stacked in either tray 76 or in output bin 80.

Invariably, after the sheet 50 is separated from photoconductive surface of belt 12, some residual particles remain adhering thereto. These residual particles are removed from photoconductive surface at cleaning station F. Cleaning station F includes a rotatably mounted fibrous brush 90 which comes in contact with photoconductive surface of belt 12. The particles are cleaned from the belt 12 by placing the surface thereof in contact with the rotating brush 90. Subsequent to cleaning, a discharge lamp (not shown) floods the photoconductive surface of belt 12 with light to dissipate any residual electrostatic charge remaining thereon prior to the charging thereof for the next successive imaging cycle.

Controller 26 is preferably a programmable microprocessor which controls all the copier 10 functions hereinbefore described. The controller 26 provides a comparison of sheets delivered to sheets transported, the number of sheets being recirculated, the number of sheets selected by the operator, time delays, jam correction, etc. The control of all exemplary systems heretofore described may be accomplished by conventional control switch inputs from the printing machine console selected by the operator. Conventional sheet path sensors or switches 92 may be utilized for keeping track of the position of sheets. In addition, controller 26 regulates the various positions of the decision gates which are dependent upon the mode of operation selected. Typically, the charge deposition process is monitored and controlled by the central process controller to maintain the needed charge characteristics. The charge control loop is closed by the main process controller adjusting the outputs of the power supply through analog control voltages. The status of the power supply is only monitored by a fault line which informs the main process controller when the power supply detects a fault such as arcing. The analog control voltage is produced by the main process controller through a converter PWB. The resultant analog voltage must then be wired to the power supply to complete the control loop. No detail status other than one fault detect signal is provided back to the main process controller.

Figure 2:
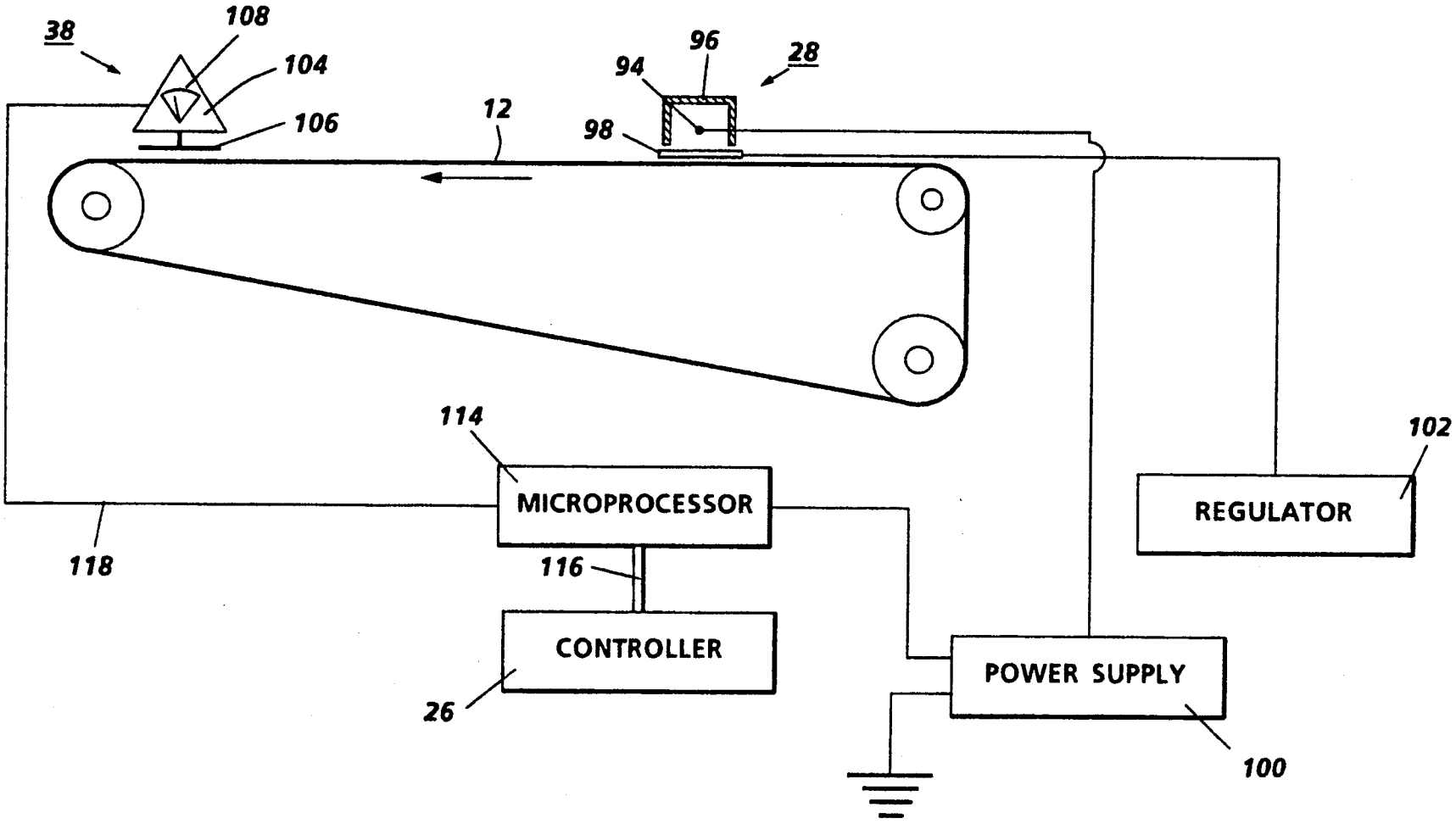
FIG. 2 is an enlarged schematic elevational view showing a corona generator and a voltage measuring device positioned adjacent the photoconductive belt of the illustrative electrophotographic printing machine of FIG. 1.

FIG. 2 illustrates, in greater detail, the operations of charging the photoconductive belt 12 and measuring the voltage potential thereof. The corona generator 28 comprises a fine wire 94, a shield 96 that encloses the wire on three sides, and a wire grid 98 that is positioned under the open side of the shield 96 intermediate to the wire 94 and the photoconductive belt 12. The wire 94 of the corona generator 28 is made of a good conductor, usually tungsten or platinum, and is connected to a power supply 100. The wire grid 98, sometimes called a screen, consists of several thin wires in a grid formation. The grid 98 is connected to the power supply 100 through a regulator 102. During charging, the power supply 100 provides a large DC voltage to wire 94 and the wire grid 98.

As a result, electrostatic fields develop between the charged wire 94 and the shield 96, between the wire 94 and the grid 98, and between the charged wire 94 and the photoconductive belt 12. Electrons are repelled from the wire 94 and the shield 96 resulting in a charge at the surface of the photoconductive belt 12.

The power supply 100 preferably provides a DC voltage operating in the range of approximately 5 kilovolts for powering the device, although greater voltage potentials and/or an AC source may potentially be used. It should be noted, however, that an AC source will be partially attenuated by parasitic capacitances existing within the circuits of the copier 10 and is therefore not preferred. It is preferable that the voltage be less than 10,000 volts in order to avoid sparking or excessive space charges in structures of practical dimensions. It has been found that the voltage potential on the photoconductive belt 12 is generally proportional to the potential of the wire grid 98. The regulator 102 is composed of conventional circuitry and can be utilized to modify the voltage of the wire grid 98 to help control the charge strength and uniformity on the photoconductive belt 12.

In accordance with the present invention, the power supply 100 uses an 8-bit microcontroller 114with built in UART and analog input/output devices to perform the serialized interface to and from a central process controller. In particular, microprocessor 114 preferably a Motorola 680584 is interconnected to controller 26 by serial communication channel 116. The serial communication channel 116 is preferably a serial bus consisting of a common set of wires bussed throughout the machine. Each "slave" smart-node is assigned an unique address designation and is connected to the serial bus. All of the control and monitor signals are converted to serialized data and communicated to and from the "master" main process controller 26 produces via the serial communication bus. The microprocessor 114 also interconnected to electrostatic voltmeter 38 by connector 118 controls the modification by the regulator 102 of the wire grid 98 potential based upon information received from the electrostatic voltmeter 38 as well as from controller 26.

Figure 3:
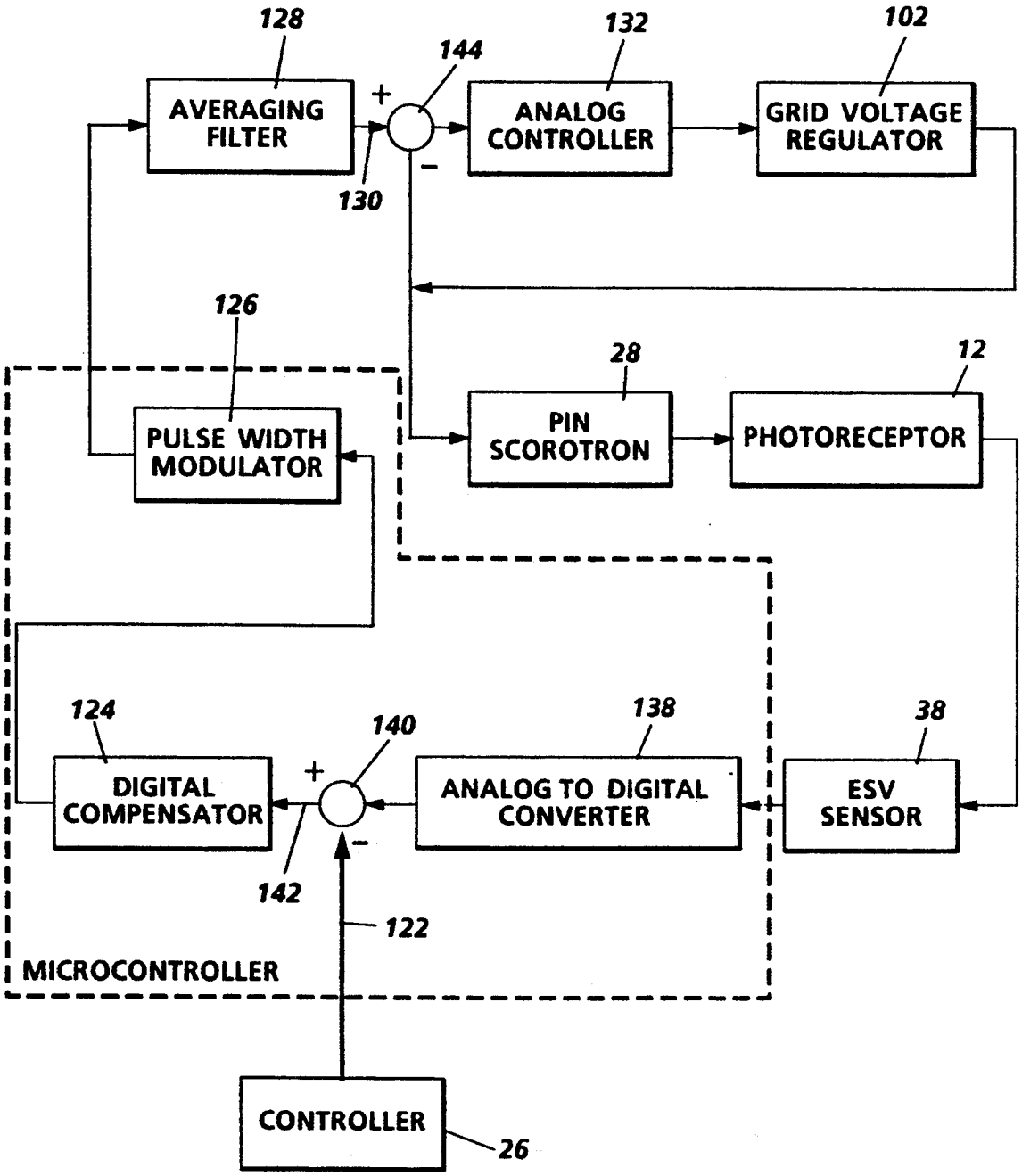
FIG. 3 is a general block diagram of a charging power supply in accordance with the present invention.

With reference to FIG. 3, main controller 26 a reference signal illustrated by the arrow 122 providing one input to the summing junction 140. The reference signal 122 from controller 26 sets the charge or operating level for pin scorotron 28. The other input to the summing junction 140 is the voltage level measured by ESV sensor 38 converted to a digital signal by the analog to digital converter 138. The output of the summing junction 140 is an error signal illustrated by the arrow 142 that is adjusted by the digital compensator 124. The output of the digital compensator 124 is encoded to a signal that can be converted to an analog signal by the pulse with modulator 126.

The modulator 126 produces a control signal for the averaging filter 128 providing one input to the summing junction 144, an analog signal illustrated by arrow 130. The output from summing junction 144 provides a signal to the analog controller 132 to set the output of the grid voltage regulator 134. The grid voltage regulator 102 operates at a relative high potential and provides an output signal to the pin scorotron 28 and to the summing junction 144.

The loop through the summing junction 144 analog controller 132, and grid voltage regulator 102 provides a continual regulator of the pin scorotron voltage in response to the reference analog signal 130. The pin scrotron 28 charges the photoreceptor with a suitable charge that is monitored by the ESV sensor 38 to repeat the control cycle.

The electrostatic voltmeter 38 generally consists of a main body 104 and a probe 106 operably interconnected by a suitable electrical connection. As the photoconductive surface of the belt 12 moves past the probe 106 a rapidly fluctuating signal is produced. A conventional comparator circuit within the main body 104 is then used to determine the voltage on the photoconductive surface. The determined voltage information is then conveyed to the controller 26 for adjustment of the regulator 102. In this manner, the potential on the wire grid 98 can be adjusted to control the voltage on the photoconductive belt 12.

It should be understood in accordance with the present invention that microprocessor 114 has inputs from appropriate devices such as indicating, recording, and/or memory storing devices indicating the values of the variables used in controlling power supply 100 such as the voltage of the wire grid 98, calculated voltage grid correction, the voltage measured on the photoconductive surface 12 the voltage desired or targeted to be on the photoconductive surface 12, the copy length of the job prior to rest, the net voltage grid change, and the rest time of the copier. For more information on stored and calculated parameters to control charging, reference is made to U.S. Pat. No. 5,164,776 issued Nov. 17, 1992 incorporated herein.

Figure 4:
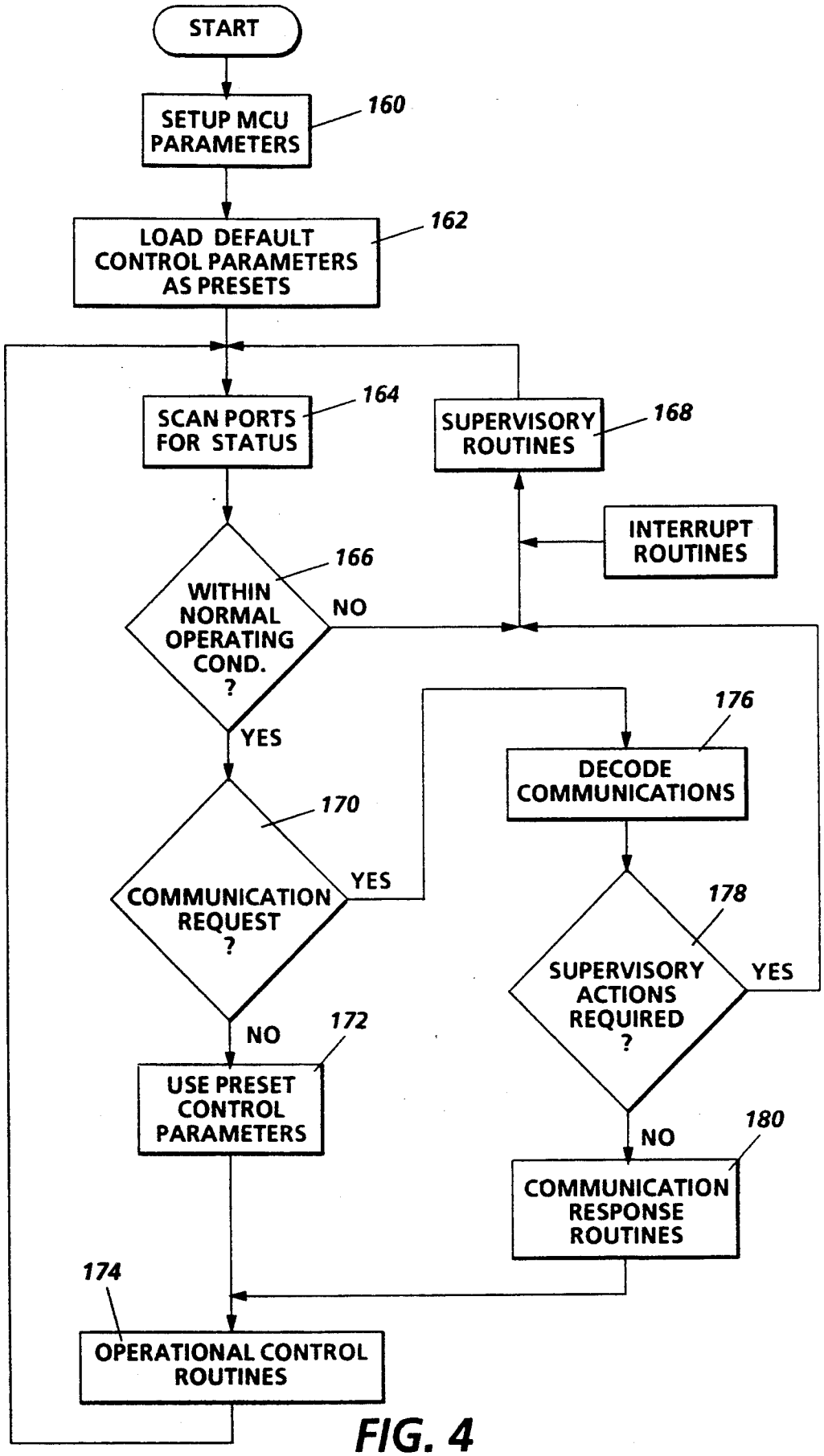
FIG. 4 is a flow chart illustrating the process of controlling a charging device in accordance with the present invention.

As discussed above with reference to FIG. 3, the charging of the photoreceptor 12 by the pin scorotron 28, is based upon an interloop reference generated by the microprocessor 114, representing the desired operating level of the power supply to achieve a specific charging objective. The interloop reference is derived from the reference signal 116 provided by the controller 26 providing a general quality or charge uniformity level. The procedure is generally shown with reference to the FIG. 4 flowchart. In particular, at block 160 the microprocessor 114 parameters are set up. At block 162, general default control parameters are loaded as presets or predetermined levels. At block 164, the mircorprocessor 114 scans various ports for a report of status and at the decision block 166, there is a determination as to whether or not the system is within normal operating conditions. If not, various supervisory routines are initiated as illustrated block 168 and the system loops back to a scanning of the ports for status at block 164.

On the other hand, if the system is within normal operating conditions, the next step is to determine if there are any communication requests at decision block 170. If there are communication requests, the requests are decoded as shown at block 176, and at block 178 a determination is made as to whether or not any supervisory actions are required. If yes, the system loops back to determine if the system is within normal operating conditions at block 166. On the other hand if supervising action is not required, at block 180 there is an initiation of communication response routines and at block 174 the initiation of the appropriate operational control routines before looping back to scan the ports for status. If on the other hand, if at block 170, there are no communication requests, the system uses the preset control parameters as illustrated at block 172 and then proceeds to the operational control routines as illustrated at block 174 before again looking back to the scan boards for status block 164.

Accordingly, it is intended to embrace all such alternatives, modifications and variations that fall within the spirit and broad scope of the appended claims.

What is claimed is:

1. In an electronic image processing apparatus having a plurality of image processing resources including an image receptor, a charging device for providing a potential on the image receptor, and a controller for directing the operation of the image processing resources to provide an image on a copy sheet, the charging device including:

a corona generator including a pin scorotron for charging a portion of the image receptor to a substantially uniform potential;

a corona generating potential source electrically connected to the corona generator;

a sensor for determining the potential on the image receptor;

a microprocessor including a pulse width modulator responsive to an error signal and electrically connected to the pin scorotron interconnected to the corona generating potential source, the sensor, and the controller for regulation of the potential on the image receptor, the microprocessor comprising a comparator providing the error signal, the error signal being a function of a signal from the sensor and a reference signal from the controller and a second comparator and a grid voltage regulator, the second comparator being external to the microprocessor, the second comparator being responsive to the pulse width modulator and the grid voltage regulator to drive the pin scorotron.

2. The apparatus of claim 1 wherein the microprocessor includes an analog to digital converter electrically connected to the sensor.

3. The apparatus of claim 1 wherein the reference signal is a signal representing image quality.

4. The apparatus of claim 1 wherein the reference signal is a signal representing charge uniformity.

* * * * *